United States Patent [19]

Haas

[11] Patent Number: 4,711,323

[45] Date of Patent: Dec. 8, 1987

[54] DOOR DRIVE FOR DOORS OF ELEVATOR CARS

[75] Inventor: Max Haas, Kriens, Switzerland

[73] Assignee: Inventio AG, Hergiwil, Switzerland

[21] Appl. No.: 797,383

[22] Filed: Nov. 12, 1985

[30] Foreign Application Priority Data

Nov. 22, 1984 [CH] Switzerland ..... 05 582/84

[51] Int. Cl.[4] ..... B66B 13/08; E05F 15/14

[52] U.S. Cl. ..... 187/52 R; 187/56; 49/360

[58] Field of Search ..... 187/52 R, 56, 51; 49/360, 352, 331, 332, 347; 474/136, 101, 165, 198, 273

[56] References Cited

U.S. PATENT DOCUMENTS

| | | | |
|---|---|---|---|
| 1,632,237 | 6/1927 | Lemon | 49/360 |
| 1,716,567 | 6/1929 | Shonnard . | |
| 1,934,867 | 11/1933 | Lindstrom et al. . | |
| 2,201,831 | 5/1940 | Jacque | 474/136 |
| 2,334,981 | 11/1943 | Ackley . | |
| 2,526,503 | 10/1950 | Raquë . | |
| 3,029,900 | 4/1962 | Baker | 187/52 R |
| 3,142,194 | 7/1964 | Garden | 474/136 |
| 4,149,615 | 4/1979 | Kappenhagen | 187/56 X |
| 4,503,637 | 3/1985 | Parente | 49/360 X |
| 4,540,387 | 9/1985 | Epino | 474/136 |

FOREIGN PATENT DOCUMENTS

| | | | |
|---|---|---|---|
| 814580 | 6/1937 | France | 187/52 |

*Primary Examiner*—Joseph J. Rolla
*Assistant Examiner*—Nils Pedersen
*Attorney, Agent, or Firm*—Werner W. Kleeman

[57] ABSTRACT

The door drive is intended for use with a relatively great number of different elevator cars, different types of sliding doors, and different widths of sliding door panels. The door drive is readily adaptable to different installations merely by appropriate adjusting and conversion work without dismounting the door drive. The door drive is fitted with its supporting structure above the door opening on the roof of the elevator car. A toothed belt serves as a drive for one panel of a sliding door and is trained around a stationary and a positionally changeable deflection roll. The positionally changeable deflection roll can be adapted to each required displacement path of a given door panel by positionally changing a shaft of such deflection roll to a preselected one of a number of fixing holes provided in the supporting structure. The maximum displacement path of the driven panel thus corresponds to the horizontal distance of the axes of the two deflection rolls increased by the radii of the two deflection rolls. Guidance of a connecting joint, arranged at the toothed belt and at a coupling bracket of the door panel, around the deflection rolls results in a gradual starting accelertion and a gradual run-out deceleration when opening or closing the sliding door.

3 Claims, 1 Drawing Figure

DOOR DRIVE FOR DOORS OF ELEVATOR CARS

BACKGROUND OF THE INVENTION

The present invention relates to a new and improved construction of a door drive for doors of elevator cars.

In its more particular aspects the present invention specifically relates to a new and improved construction of a door drive for a horizontally opening elevator car sliding door. This sliding door contains at least one door panel of a predetermined width. The door drive contains at least one driving means comprising endless belt-shaped driving means guided at two deflection rolls or pulleys which are arranged at a supporting structure of the elevator car. The driving means are driven by a motor. At the drive run of the belt-shaped driving means, there is arranged at least one entrainment or coupling bracket which is fixed to one panel of the sliding door. The door drive can be selectively utilized for various door panel widths.

In a motor-driven multicomponent sliding door for an elevator car as known, for example, from German Utility Model No. 7,044,605.8, published May 19, 1971, each trailing door panel moves half as quickly as the related leading door panel. The drive motor is arranged at the slow-moving door panel and drives one of two chains which are guided at deflection sprocket wheels also arranged at the door panel. A door entrainment or coupling bracket of a leading door panel is fastened to the drive run of the aforementioned one chain.

It is a disadvantage of this arrangement that during each door movement the mass of the whole door drive must be moved. The usually small clearance between the elevator car and the elevator hoistway or shaft has to be correspondingly enlarged for free travel of the door drive motor. A further disadvantage exists in that a flexible supply line or conductor is required for powering the drive motor.

A door drive as known, for example, from U.S. Pat. No. 4,149,615, granted Apr. 17, 1979, is arranged on the roof of an elevator car and is suitable for different cars, different types of sliding doors and different door widths. In FIG. 1 of this patent there is shown a telescopic sliding door equipped with a fast-moving door panel and a slow-moving door panel. The slow-moving door panel is driven by means of an endless drive belt which extends over the whole width of the car. At the same door panel there is constructed a drive arrangement for displacing or moving the second door panel at a greater speed. The complete door driving means is arranged on supporting structure which in its extent corresponds to the total width of the elevator car and which can be adjusted in horizontal direction and vertical direction. The complete door driving means is connected with the elevator car via damping or shock-absorbing elements.

It is a disadvantage of this door drive that the driving means extends over practically the entire width of the elevator car and projects on one side by more than one door panel width beyond the closed door in the closed state of the elevator car opening. As a result, follow-up or retro-adjusting work is required for adapting the supporting structure to different elevator car widths, and also transport and mounting problems may arise due to the possible great lengths or extents of the supporting structure. Apart therefrom the door drive does not possess gradual starting acceleration or run-out deceleration due to a deflection of the driving means when opening or closing the sliding door.

SUMMARY OF THE INVENTION

Therefore with the foregoing in mind it is a primary object of the present invention to provide a new and improved construction of a door drive for doors of elevator cars and which does not suffer from the aforementioned drawbacks and shortcomings of the prior art constructions.

A further important object of the present invention is to provide a new and improved construction of a door drive for doors, specifically sliding doors of elevator cars, and which is usable without retro-adjustments for different types of sliding doors, for different widths of sliding doors, and for different elevator cars, and which door drive only slightly exceeds in its extent the width of the widest door panel of such elevator doors.

Yet a further significant object of the present invention is to provide a new and improved construction of a door drive for doors of elevator cars and which possesses gradual starting acceleration and gradual run-out deceleration when opening or closing sliding doors.

Now in order to implement these and still further objects of the invention, which will become more readily apparent as the description proceeds, the door drive of the present development is manifested by the features that the supporting structure of the door drive comprises a stationary deflection roll or pulley and a positionally changeable deflection roll or pulley. The supporting structure has arranged thereat a predetermined number of selector or fixing holes which accommodate the axle or shaft of the positionally changeable deflection roll or pulley and which correspond to the respective door panel widths. The center distance between the stationary and the positionally changeable deflection rolls or pulleys approximately conforms with the widths of related door panels decreased by the two radii of the stationary and the positionally changeable deflection rolls or pulleys.

It is one advantage achieved by the present invention that only a single door drive is required which exceeds the width of the associated door panel only by a small extent and which permits a gradual starting acceleration and gradual run-out deceleration when opening or closing a sliding elevator door. The inventive door drive can be used for different elevator car sizes, different sliding door types, and different door widths. For adaptation to related door widths, one of the two deflection rolls or pulleys of the driving means must be inserted into the appropriate selector or fixing hole and the driving means must be replaced or adapted to the required length. A corresponding belt joint is also provided for the toothed belt which constitutes the aforementioned driving means. By means of such belt joint the toothed belt can be adjusted to the required length in the simplest manner. The distance between two selector or fixing holes for the positionally changeable deflection rolls or pulleys always amounts to an integer multiple of the pitch of the toothed belt which, for adaptation to a given door width, can be shortened such that the two belt ends are always joined with the belt lock only in the middle of a tooth space.

BRIEF DESCRIPTION OF THE DRAWINGS

The invention will be better understood and objects other than those set forth above will become apparent when consideration is given to the following detailed description thereof. Such description makes reference to the annexed single FIGURE of the drawing which shows in elevation an exemplary embodiment of the inventive door drive which is mounted on the roof of an elevator car.

DETAILED DESCRIPTION OF THE PREFERRED EMBODIMENTS

Figure 1:
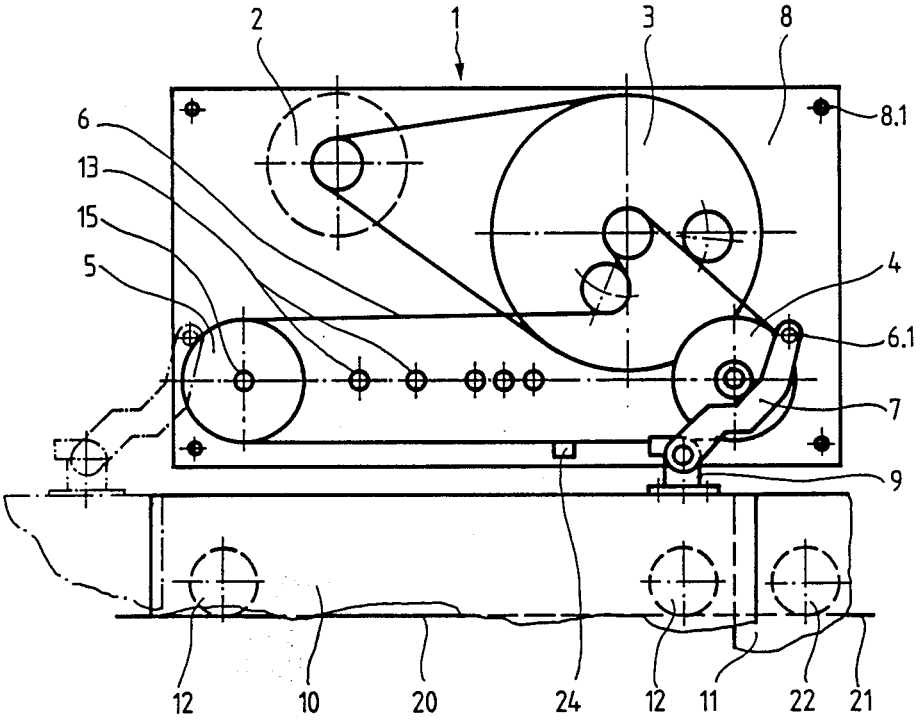

Describing now the single drawing, it is to be understood that to simplify the showing thereof, only enough of the door drive for doors of elevator cars has been illustrated therein as is needed to enable one skilled in the art to readily understand the underlying principles and concepts of this invention. Turning now specifically to the single FIG. 1 of the drawing, the inventive door drive illustrated therein by way of example and not limitation will be seen to comprise an elevator car door drive generally designated by the reference numeral 1.

An electric motor 2 drives via a belt gearing or reduction drive means or transmission 3 a toothed belt 6 which is deflected or trained around a stationarily positioned deflection roll or pulley 4 and a positionally changeable deflection roll or pulley 5. The electric motor 2, the belt gearing or reduction drive means or transmission 3, and the deflection rolls or pulleys 4 and 5 together with the toothed belt 6 are mounted at a common supporting structure 8. The supporting structure 8 is fixed to the roof of the elevator car by a suitable holding means 8.1.

A first door panel 10 with two support rolls 12 and a second, merely generally indicated door panel 11 with a support roll 22 displaceably bear upon two rails 20 and 21 which are substantially parallelly arranged next to each other. A door coupler 9 is provided at the first door panel 10. A connecting joint 6.1, which is arranged at the toothed belt 6, and the door coupler 9 are linked to each other by means of an entrainment or coupling bracket 7. The toothed belt 6 is endlessly connected by means of a belt joint or lock 24, i.e. a splice, which at the same time serves as a stop for limiting the opening movement or travel of the door panel 10.

A predetermined number of selector or fixing holes 13 is provided in the supporting structure 8, for corresponding to a number of different standardized door panels 10 and for accommodating the positionally changeable deflection roll or pulley 5. A shaft or rotary axle 15 carries the positionally changeable deflection roll or pulley 5 and is fastened in a preselected selector or fixing hole 13 corresponding to the associated door panel 10.

The first or driven door panel 10 of a sliding door may constitute a single panel of a conventional single panel sliding door, a panel of a centrally opening sliding door containing two panels moveable in opposite directions, or the slow-moving panel of a telescopic sliding door containing at least two door panels 10 and 11 which move in the same direction. The transmission of the driving forces from the driven door panel 10 to an associated door panel 11 is effected in a manner which is already known as such and therefore not particularly here illustrated and described. All the drive components required for driving an associated door panel 10 are mounted or installed at the supporting structure 8 which is arranged at the roof of the elevator car by the holding means 8.1. There are also provided all the selector or fixing holes 13 for the positionally changeable deflection roll or pulley 5 and which are required for all standardized door widths in the door width range between 600 and 1100 mm. The center distances between the stationary deflection roll or pulley 4 and the selector or fixing holes 13 required for accommodating the positionally changeable deflection roll 5 approximately correspond to the related door panel widths minus the two radii of the stationary and the positionally changeable deflection rolls or pulleys 4 and 5.

Consequently, the maximal displacement or travel distance of the driven door panel 10 is the same as the horizontal distance or spacing between two tangents applied from the outside to each one of the deflection rolls or pulleys 4 and 5. Due to guiding action of the connecting joint 6.1 of the entrainment or coupling bracket 7 around the curvature of the deflection rolls 4 and 5 at the start and at the end of the door movement, there result gradual starting accelerations and gradual run-out decelerations for the door panel or door panels when opening or closing the sliding door. The shaft or rotary axle 15 of the positionally changeable deflection roll or pulley 5 can be inserted into the preselected selector or fixing hole 13 which corresponds to the associated door panel width in order to obtain the correct path or travel length for the required door movement. Consequently, when employing the inventive door drive, the door driving means remain the same and it is only necessary to install the positionally changeable deflection roll or pulley 5 at the correct distance or spacing relative to the stationary deflection roll or pulley 4 and to employ a toothed belt 6 of the correct total length. This can be achieved either by means of a corresponding replacement belt or by shortening the existing toothed belt 6. The door widths are standardized in steps which correspond to integer multiples of the pitch of the toothed belt. Therefore, the toothed belt 6, when shortened as required by an amount which corresponds to twice the amount of the step size, can always be shortened exactly at the center of a tooth space. The belt joint or lock 24 provided for the two belt ends is constructed such that the toothed belt 6 ends must each start at half a tooth space.

While there are shown and described present preferred embodiments of the invention, it is to be distinctly understood that the invention is not limited thereto, but may be otherwise variously embodied and practiced within the scope of the following claims. Accordingly,

What I claim is:

1. A door drive for horizontally opening elevator car sliding door containing at least one door panel of a selectably predeterminate width, comprising:

a supporting structure fixed to the roof of said elevator car;

a motor fixed to said supporting structure;

two deflecting rolls arranged at said supporting structure;

at least one endless belt-shaped driving means drivingly connected with said motor and trained around said two deflection rolls;

said at least one endless belt-shaped driving means defining a drive run;

at least one coupling bracket arranged at said drive run of said endless belt-shaped driving means and mounted at said at least one door panel of said sliding door of said elevator car;

said door drive being adaptable to differently selected widths of said at least one door panel of said sliding door of said elevator car;

said two deflecting rolls arranged at said supporting structure of said door drive comprising a stationary deflection roll having an axis and a positionally changeable deflection roll having an axis and containing a shaft;

said supporting structure being provided with a predetermined number of fixing holes for selectively acccommodating said shaft to said positionally changeable deflection roll;

said fixing holes being arranged in said supporting structure at predetermined positions relative to said stationary deflection roll such that said axes of said stationary deflection roll and said positionally changeable deflection roll are arranged at a preselected center distance when said positionally changeable deflection roll is accomodated in a preselected one of said predetermined number of fixing holes provided in said supporting structure to thus adapt the door drive and the supporting structure to a selected value of the selectively predeterminate width of said at least one door panel;

each deflection roll of said stationary deflection roll and said positively changeable deflection roll having a respectively radius; and said preselected center distance between said stationary deflection roll and said positively changeable deflection roll approximately corresponding to the selected value of the selectably predeterminate width of said at least one door panel minus said respective radii of said stationary deflection roll and said positionally changeable deflection roll.

2. The door drive as defined in claim 1, wherein:

said at least one door panel is movable between a closed position and an open position during opening and closing of the at least one door panel;

said at least one endless belt-shaped driving means dirvingly connected with said motor and trained around said two deflection rolls comprises a toothed belt;

said toothed belt being provided with a connecting joint;

a door coupler provided for said at least one door panel;

said at least one coupling bracket operatively connecting said toothed belt with said door coupler; and said connecting joint of the toothed belt being guided around said two deflecting rolls so that at the start and end of the movement of said at least one door panel there result gradual starting accelerations and gradual run-out accelerations for said at least one door panel during opening and closing of said at least one door panel.

3. The door drive as defined in claim 2, wherein:

said toothed belt has a predeterminate pitch; and said predetermined number of fixing holes having a predeterminate spacing from one another and the distance between each two neighboring ones of said fixing holes amounting to an integer multiple of the pitch of the toothed belt.

* * * * *

UNITED STATES PATENT AND TRADEMARK OFFICE

CERTIFICATE OF CORRECTION

PATENT NO. : 4,711,323

DATED : December 8, 1987

INVENTOR(S) : MAX HAAS

It is certified that error appears in the above-identified patent and that said Letters Patent is hereby corrected as shown below:

Claim 1, line 1, after "for" please insert --a--

Column 5, line 23, after "said" please delete "positively" and insert --positionally--

Column 5, line 24, delete "respectively" and insert --respective--

Column 5, line 26, please delete "positively" and insert --positionally--

Column 6, line 8, please delete "dirvingly" and insert --drivingly--

Signed and Sealed this

Tenth Day of May, 1988

*Attest:*

*Attesting Officer*

DONALD J. QUIGG

*Commissioner of Patents and Trademarks*